US010787833B1

(12) United States Patent
Apel

(10) Patent No.: US 10,787,833 B1
(45) Date of Patent: Sep. 29, 2020

(54) FLAGPOLE HAVING DECORATIVE SPORTING EQUIPMENT SECTION

(71) Applicant: George Apel, Sedalia, MO (US)

(72) Inventor: George Apel, Sedalia, MO (US)

( * ) Notice: Subject to any disclaimer, the term of this patent is extended or adjusted under 35 U.S.C. 154(b) by 504 days.

(21) Appl. No.: 15/798,537

(22) Filed: Oct. 31, 2017

(51) Int. Cl.
*E04H 12/32* (2006.01)
*G09F 17/00* (2006.01)

(52) U.S. Cl.
CPC ..... *E04H 12/32* (2013.01); *G09F 2017/0066* (2013.01)

(58) Field of Classification Search
CPC ..... E04H 12/32; G09F 2017/0066
See application file for complete search history.

(56) References Cited

U.S. PATENT DOCUMENTS 314,324 A * 3/1885 Folsom ..... B61L 5/125 246/477
D28,804 S * 6/1898 Gerritson ..... D26/94
968,067 A * 8/1910 Mowry ..... G09F 17/00 116/173
1,048,291 A * 12/1912 Buckley ..... G09F 17/00 116/174
D54,325 S * 12/1919 Martin ..... D26/94
1,383,234 A 6/1921 Raguse
1,551,742 A * 9/1925 Hise ..... F41G 1/35 362/187
1,923,531 A * 8/1933 De Florez ..... F41A 33/02 362/113
2,199,897 A * 5/1940 Stringer ..... E04H 12/187 52/152
2,314,061 A * 3/1943 Whaley ..... F41G 11/002 362/110
2,507,623 A * 5/1950 Diaz ..... E04H 12/32 116/174
2,597,565 A * 5/1952 Chandler ..... F41G 1/35 362/110
2,769,895 A * 11/1956 Boord ..... F41G 11/004 211/26
3,106,348 A * 10/1963 Robinson ..... F41G 11/001 362/110
D365,308 S * 12/1995 White ..... D11/181
5,572,835 A 11/1996 Atkins
D464,587 S * 10/2002 Ursprung ..... D11/165
(Continued)

FOREIGN PATENT DOCUMENTS

WO 2005008618 A1 1/2005

*Primary Examiner* — Nimeshkumar D Patel
*Assistant Examiner* — Tania Courson

(57) ABSTRACT

The flagpole having decorative sporting equipment section comprises a pole that incorporates a decorative section into its design. The decorative section is functional because it substitutes for a portion of the pole and provides elevation for a flag. The decorative section may be the topmost portion of the flagpole or it may divide the pole into an upper pole and a lower pole with the decorative section in the middle. The flagpole having decorative sporting equipment section may provide a path through the center of the flagpole for a portion of the halyard to travel. The decorative section may be designed to resemble a sporting object such as a lever rifle. A section of the rifle resembling a gun sight may comprise a light source to provide illumination for the flag at night.

14 Claims, 7 Drawing Sheets

(56) References Cited

U.S. PATENT DOCUMENTS

| | | | | |
|---|---|---|---|---|
| 6,908,206 | B1 * | 6/2005 | Pinciaro | A41D 27/085 362/34 |
| 6,955,456 | B2 | 10/2005 | Schroeder | |
| D529,839 | S | 10/2006 | Howald | |
| 7,334,535 | B1 * | 2/2008 | Somers | G09F 17/00 116/173 |
| 7,337,577 | B1 * | 3/2008 | Ramirez | A01K 97/125 362/120 |
| 8,584,392 | B1 * | 11/2013 | Young | F41G 1/35 42/114 |
| 8,621,771 | B2 | 1/2014 | Amalaha | |
| D706,673 | S | 6/2014 | Lingo | |
| D729,117 | S | 5/2015 | Bishop | |
| 9,159,254 | B2 * | 10/2015 | Oyoung | G09F 17/00 |
| 9,255,770 | B1 * | 2/2016 | DiCorte | F41G 1/38 |
| D880,348 | S * | 4/2020 | Kauk | D11/172 |
| D886,664 | S * | 6/2020 | Kauk | D11/172 |
| 2009/0009987 | A1 * | 1/2009 | Graham | F21V 21/0885 362/110 |
| 2009/0290365 | A1 * | 11/2009 | Schroeder | G09F 17/00 362/431 |
| 2014/0251201 | A1 | 9/2014 | Lingo | |
| 2017/0008025 | A1 * | 1/2017 | Vincent | F21V 33/0084 |

* cited by examiner

FLAGPOLE HAVING DECORATIVE SPORTING EQUIPMENT SECTION

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lawn ornamentation, more specifically, a flagpole having decorative sporting equipment section.

SUMMARY OF INVENTION

The flagpole having decorative sporting equipment section comprises a pole that incorporates a decorative section into its design. The decorative section is functional because it substitutes for a portion of the pole and provides elevation for a flag. The decorative section may be the topmost portion of the flagpole or it may divide the pole into an upper pole and a lower pole with the decorative section in the middle. The flagpole having decorative sporting equipment section may provide a path through the center of the flagpole for a portion of the halyard to travel. The decorative section may be designed to resemble a sporting object such as a lever rifle. A section of the rifle resembling a gun sight may comprise a light source to provide illumination for the flag at night.

An object of the invention is to provide a flagpole that incorporates a decorative section into its design.

Another object of the invention is to provide a flagpole where the decorative section reassembles a lever rifle.

Yet another object of the invention is to provide a path through the center of the flagpole for a portion of the halyard to travel.

A further object of the invention is to provide a gun sight on the rifle that provide illumination for a flag.

These together with additional objects, features and advantages of the flagpole having decorative sporting equipment section will be readily apparent to those of ordinary skill in the art upon reading the following detailed description of the presently preferred, but nonetheless illustrative, embodiments when taken in conjunction with the accompanying drawings.

In this respect, before explaining the current embodiments of the flagpole having decorative sporting equipment section in detail, it is to be understood that the flagpole having decorative sporting equipment section is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flagpole having decorative sporting equipment section.

It is therefore important that the claims be regarded as including such equivalent construction insofar as they do not depart from the spirit and scope of the flagpole having decorative sporting equipment section. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
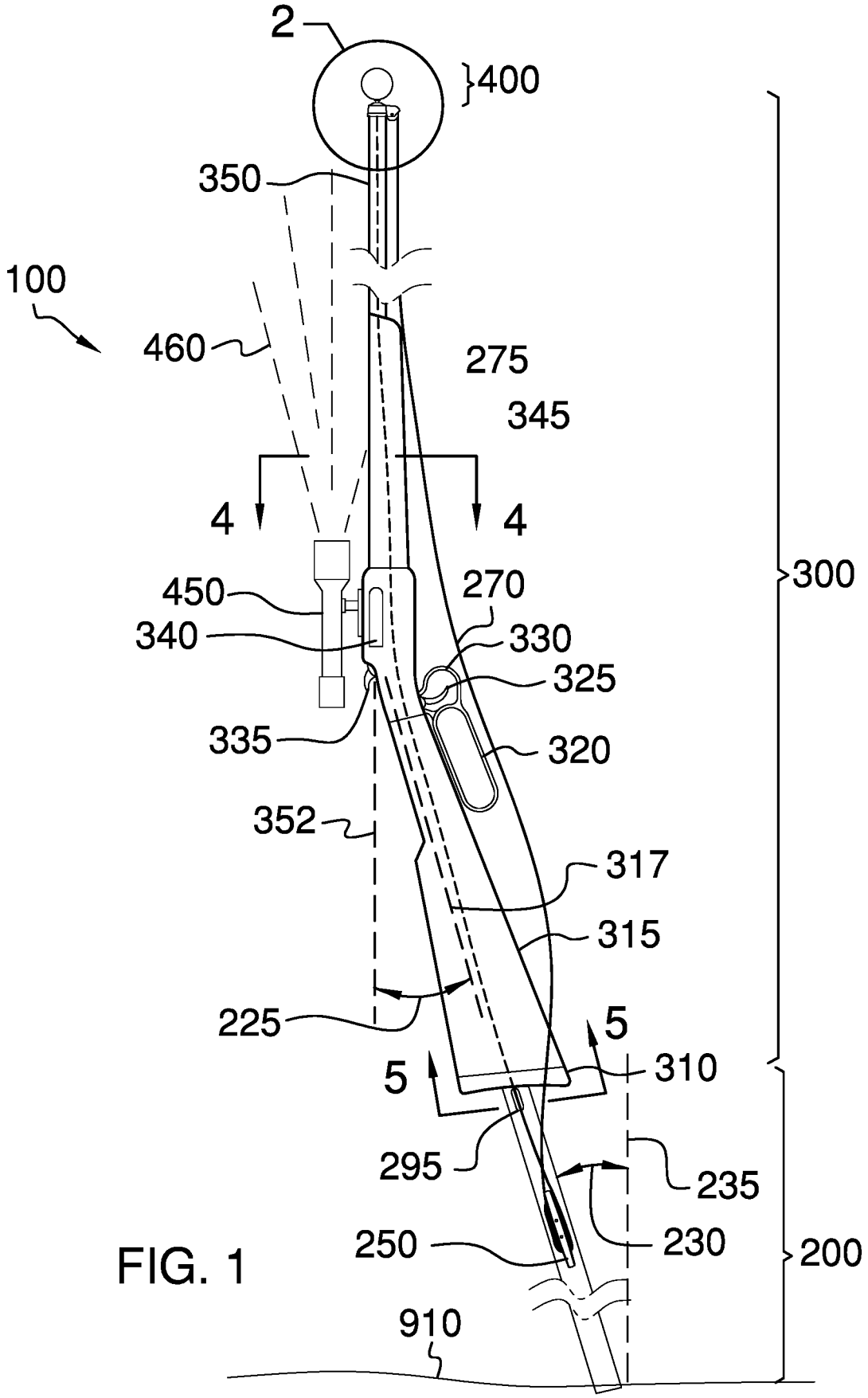
FIG. 1 is a side view of an embodiment of the disclosure.
Figure 2:
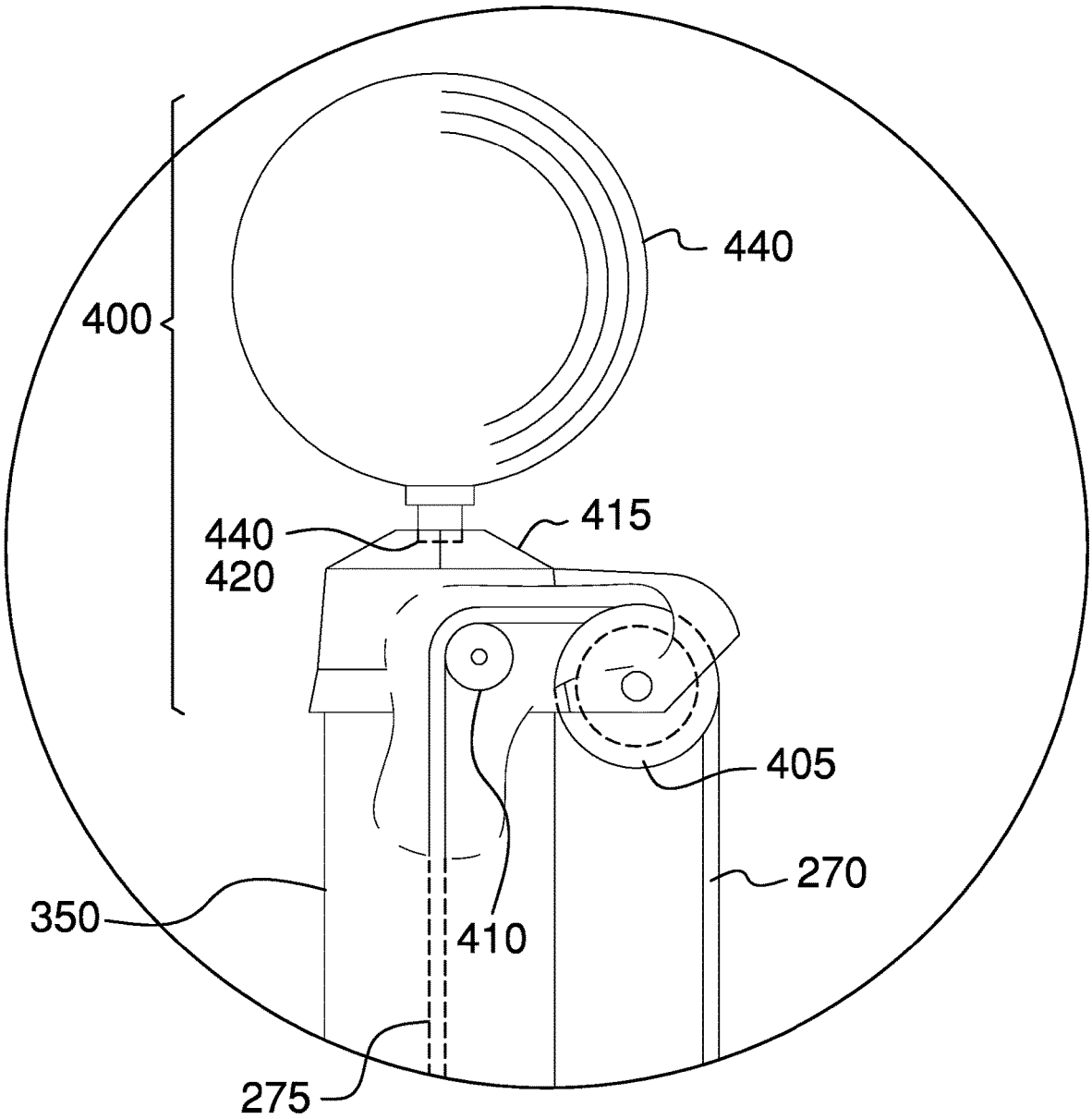
FIG. 2 is a detail view of an embodiment of the disclosure focusing on the truck assembly indicated in FIG. 1.
Figure 3:
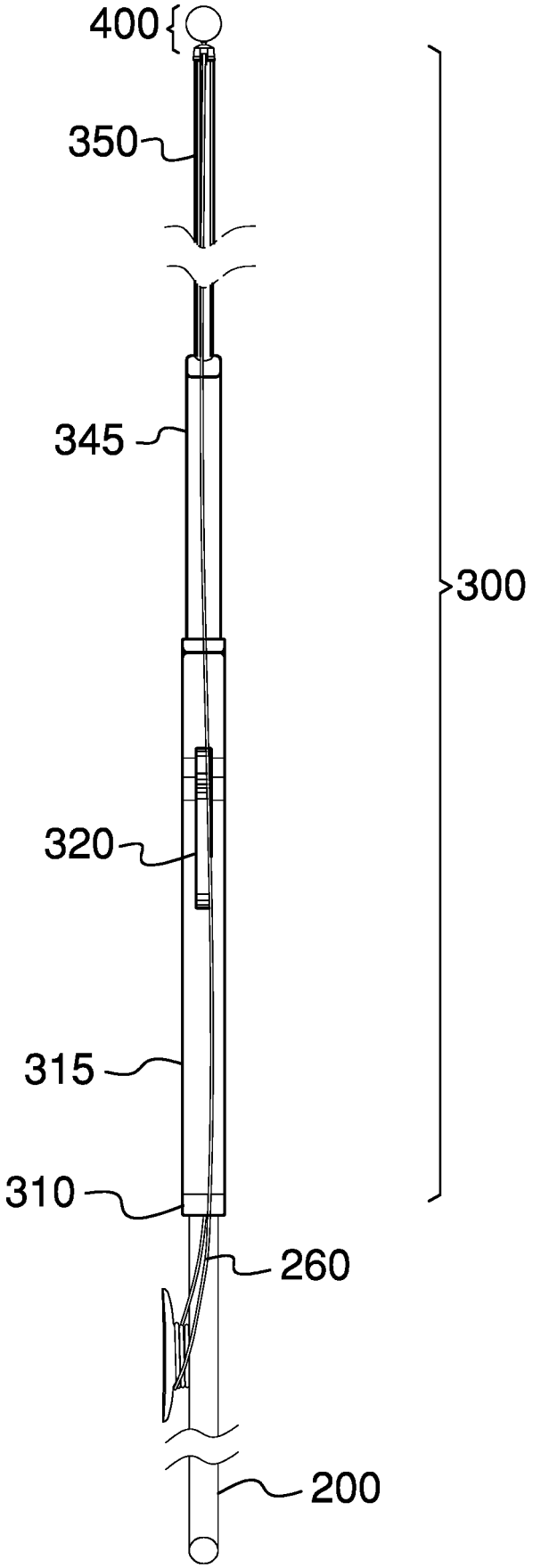
FIG. 3 is a front view of an embodiment of the disclosure.
Figure 4:
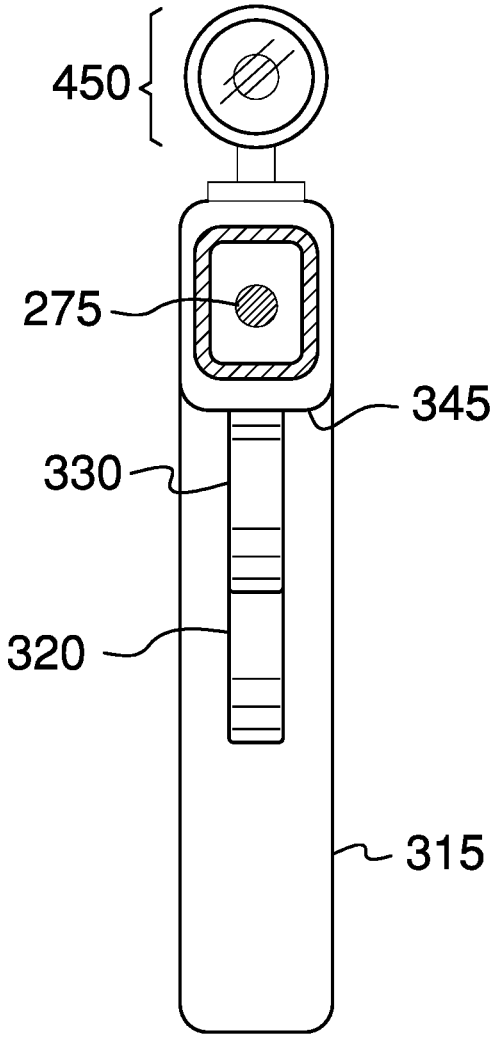
FIG. 4 is a cross-sectional view of an embodiment of the disclosure across 4-4 as shown in FIG. 1.
Figure 5:
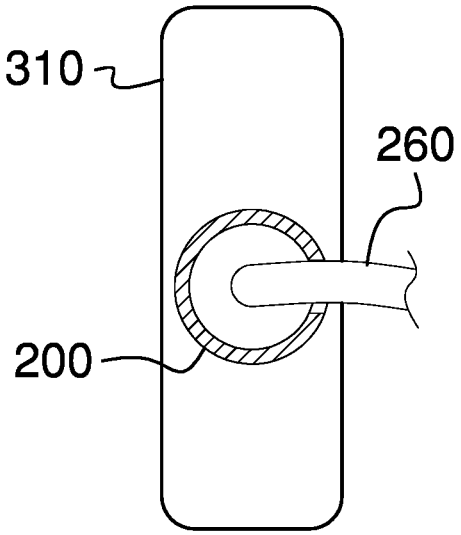
FIG. 5 is a cross-sectional view of an embodiment of the disclosure across 5-5 as shown in FIG. 1.
Figure 6:
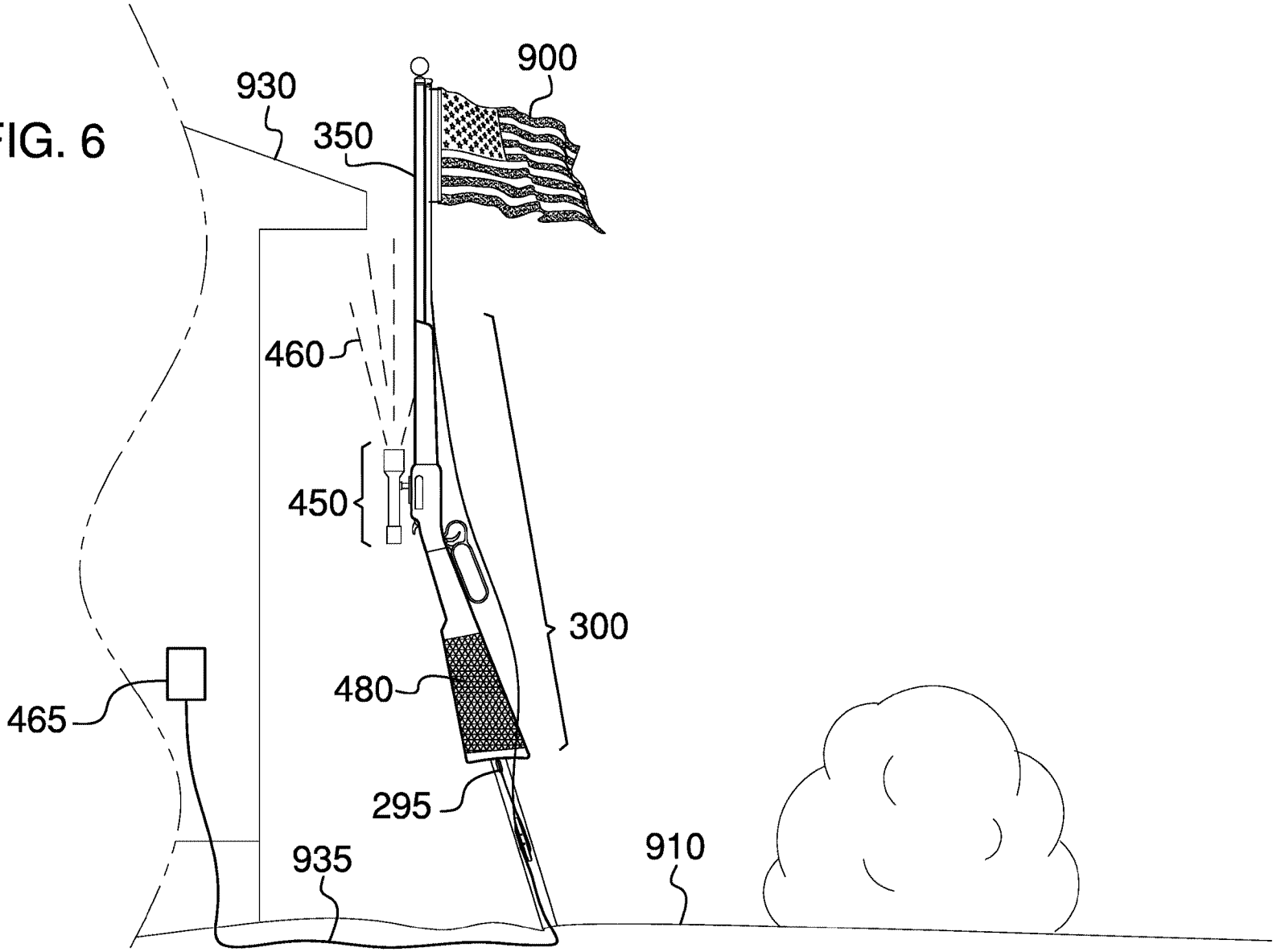
FIG. 6 is a side view of an embodiment of the disclosure while in use.
Figure 7:
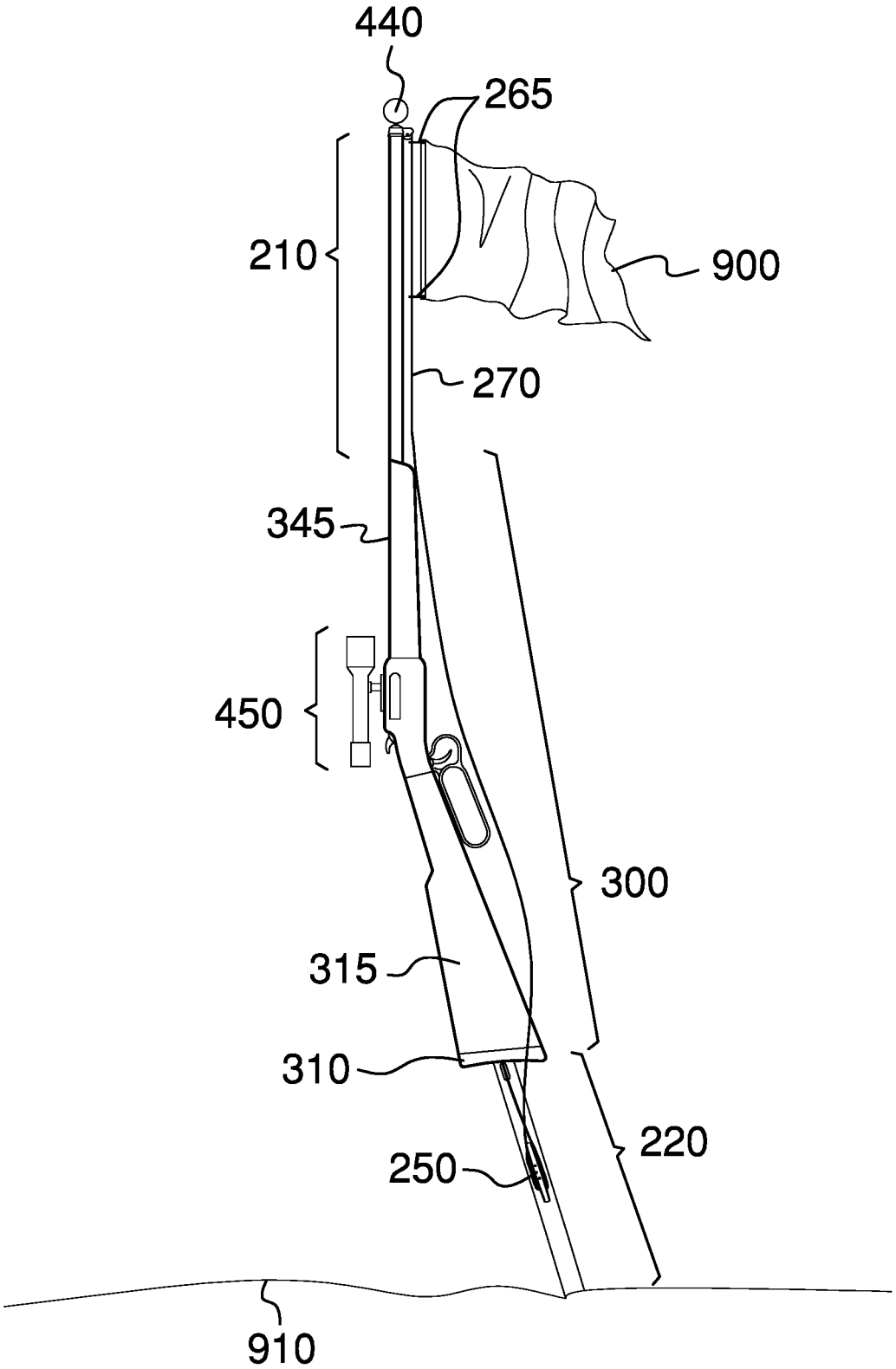
FIG. 7 is a side view of a second embodiment of the disclosure where the decorative section divided the pole into an upper pole and a lower pole.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 7.

The flagpole having decorative sporting equipment section 100 (hereinafter invention) comprises a decorative section 300, a pole 200, and a halyard 260. The decorative section 300 may functionally substitute for a length of the pole while simultaneously providing a novel appearance.

The decorative section 300 may couple to the pole 200 and may serve as an extension of the pole 200. The decorative section 300 may be shaped like a sporting object. As non-limiting examples, the decorative section 300 may be shaped like a fishing rod, a hockey stick, a baseball bat, an oar, a golf club, or a pair of skis. In some embodiments, the decorative section 300 may be shaped like a rifle. A realistic appearance of the rifle may be achieve by including simulated rifle features. As non-limiting examples, the simulated rifle features may comprise any combination of a recoil pad 310, a buttstock 315, a finger lever 320, a trigger 325, a trigger guard 330, a hammer 335, an ejection port 340, a forestock 345, a barrel 350, a gun sight 450 or other components of the rifle.

In some embodiments, the bottom of the decorative section 300 may couple to the top of the pole 200 and a truck assembly 400 may couple to the top of the decorative section 300 (see FIG. 1).

In some embodiments, the decorative section 300 may divide the pole 200 into an upper pole 210 and a lower pole 220. In these embodiments, the bottom of the upper pole 210 may couple to the top of the decorative section 300, the bottom of the decorative section 300 may couple to the top of the lower pole 220, and the truck assembly 400 may couple to the top of the upper pole 210 (see FIG. 7).

Throughout the remainder of this disclosure, the term 'top section of the flagpole' shall be understood to mean either the decorative section 300 or the upper pole 210 depending upon whether the embodiment places the decorative section 300 at the top of the invention 100 or uses the decorative section 300 to divide the pole 200 into the upper pole 210 and the lower pole 220.

The pole 200 may be a hollow metal cylinder that serves to elevate a flag 900. The bottom of the pole 200 may be embedded into ground 910 to hold the invention 100 upright.

In some embodiments, the invention 100 may comprise a cleat 250. The cleat 250 is generally no higher than 6 ft above the ground 910 level so that a user may reach it. The halyard 260 is wrapped around the cleat 250 to prevent the flag 900 from moving up or down once the flag 900 has been placed at a desired height. In some embodiments, the cleat 250 may be coupled to the pole 200. In some embodiments, the cleat 250 may be located on the decorative section 300.

The halyard 260 allows the flag 900 to be raised and lowered from the ground 910. The halyard 260 is a loop of rope having a first run of rope 270 and a second run of rope 275. The flag 900 is clipped onto the first run of rope 270. As a non-limiting example, a pair of snap hooks 265 may be used to couple the flag 900 to the first run of rope 270. The flag 900 may be raised by pulling down on the second run of rope 275. The flag 900 may be lowered by pulling down on the first run of rope 270.

In some embodiments, the invention 100 may comprise a halyard aperture 295. The halyard aperture 295 may allow the second run of rope 275 to pass through the center of the pole 200 and through the decorative section 300 to reach the truck assembly 400. The first run of rope 270 may run from the truck assembly 400 to the bottom of the invention 100 outside of the pole 200 and outside of the decorative section 300. The halyard aperture 295 may be located on either the pole 200 or the decorative section 300.

In some embodiments, the pole 200 may be angled with respect to vertical. As a non-limiting example, for the embodiment of the invention 100 shown in FIG. 1, a longitudinal axis of the barrel 352 of the rifle and a longitudinal axis of the buttstock 317 intersect at a first angle of intersection 225 which may be approximately 10 to 20 degrees. The pole 200 may form a second angle of intersection 230 with respect to a vertical vector 235. The second angle of intersection 230 may be oriented to place its apex at the point where the bottom of the pole 200 meets the ground 910. If the second angle of intersection 230 is the same angular measurement as the first angle of intersection 225 then the first angle of intersection 225 and the second angle of intersection 230 are alternate interior angles of two parallel lines intersected by a third line. The two parallel lines are the vertical vector 235 and the longitudinal axis of the barrel 352 and the intersecting line is the longitudinal axis of the buttstock 317. This means that the barrel 350 of the rifle is parallel to the vertical vector 235 and therefore the barrel 350 points straight up.

The gun sight 450 may be a decorative part of the rifle and may also perform the function of providing an illumination 460 for the flag 900 at night. A light source (not illustrated in the figures) may be located at the top of the gun sight 450 and may point up towards the flag 900. The light source may be powered by an external power source 465, by batteries (not illustrated in the figures) located within the decorative section 300, by solar cells (not illustrated in the figures), or by a combination thereof. As non-limiting examples, the external power source 465 may be an AC or DC power source coupled via wiring 935 to an AC circuit of a nearby building 930. As a non-limiting example, the batteries may be located within the gun sight 450 and may be replaceable by removing the light source or another part of the gun sight 450. As a non-limiting example, the solar cells may be incorporated into the decorative aspect of the decorative section 300, such as appearing to be a buttstock cuff 480, and the solar cells may be used to recharge the batteries during daylight hours. The invention 100 may comprise a timer circuit (not illustrated in the figures) and/or a light sensor circuit (not illustrated in the figures) to turn the light source on at dusk.

The truck assembly 400 comprises a cap 415, an external pulley 405, a threaded aperture for the finial 420, and a finial 440. The truck assembly 400 may provide a mechanism at the top of the top section of the flagpole that reduces the friction of the halyard 260 as it turns 180 degrees. The cap 415 may form a protective barrier at the top section of the flagpole and may provide a point of attachment for the finial 440 in the form of the threaded aperture for the finial 420. The finial 440 may be a ornament for the top of the top section of the flagpole. As a non-limiting example, the finial 440 may be a round ball, a spread-wing eagle, a spike, or other decorative adornment. The design of the finial 440 may be selected to appropriately match the theme of the decorative section 300. The bottom of the finial 440 may provide a threaded interface that couples to the threaded aperture for the finial 420 located on the cap 415.

The external pulley 405 may be coupled to an extension of the cap 415, which places the center of the external pulley 405 outside of the top section of the flagpole. This may position the external pulley 405 to direct the first run of rope 270 down vertically from the external pulley 405 and outside of the top section of the flagpole. In some embodiments where the halyard 260 is entirely outside of the top section of the flagpole, the external pulley 405 may be positioned entirely outside of the top section of the flagpole so that the second run of rope 275 is also directed down vertically from the external pulley 405 and outside of the top section of the flagpole.

In some embodiments, the truck assembly 400 may further comprise a halyard redirector 410. As non-limiting examples, the halyard redirector 410 may be an internal pulley (not illustrated in the figures) or a round, horizontal bar. The halyard redirector 410 may be located directly under the cap 415 and inside of the top section of the flagpole. The halyard redirector 410 may redirect the movement of the halyard 260 by 90 degrees so that vertical movement of the second run of rope 275 up or down through the top section of the flagpole is translated into horizontal movement of the second run of rope 275 between the halyard redirector 410 and the external pulley 405. In this configuration, the first run of rope 270 travels vertically outside of the top section of the flagpole, the second run of rope 275 travels vertically inside of the top section of the flagpole, and a segment of the halyard 260 travels horizontally between the external pulley 405 and the halyard redirector 410 just below the cap 415 to get from outside of the top section of the flagpole to inside the top section of the flagpole or vice versa.

Unless otherwise stated, the words "up", "down", "top", and "bottom" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object.

As used in this disclosure, "AC" is an acronym for alternating current.

As used in this disclosure, an "aperture" is an opening in a surface. Aperture may be synonymous with hole, slit, crack, gap, slot, or opening.

As used in this disclosure, a "ball" refers to an object with a spherical or nearly spherical shape.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may be construed to mean recharging or replacing individual cells, individual batteries of cells, or a package of multiple battery cells as is appropriate for any given battery technology that may be used.

As used in this disclosure, a "cleat" is an object around which a rope, cord, or wire can be secured.

As used herein, the words "couple", "couples", "coupled" or "coupling", mean connected, either directly or indirectly and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically means a right cylinder, which is defined as a cylinder wherein the curved surface perpendicularly intersects with the two identical flat and parallel ends.

As used in this disclosure, "DC" is an acronym for direct current.

As used in this disclosure, an "external power source" is a source of the energy that is externally provided to enable the operation of the present disclosure. Examples of external power sources include, but are not limited to, electrical power sources and compressed air sources.

As used in this disclosure, a "flag" is a textile or sheeting material that attached by one edge to a pole or a rope. In general usage, a flag will display an image that often contains some form of symbolic meaning or message. This definition maps to the common patent classification definitions and is therefore explicitly intended to include flag like objects commonly referred to as a "banner".

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, a "light" is an electrical device that generates visible light to illuminate objects so they can be seen.

As used herein, the word "longitudinal" refers to a lengthwise direction.

As used in this disclosure a "pulley" is a wheel with a grooved rim around which a cord (or other form of rope, line, or cable) passes. The pulley is used to change the direction of a force applied to the cord.

As used in this disclosure, a "sensor" is a device that receives and responds in a predetermined way to a signal or stimulus.

As used in this disclosure, "vertical" refers to a direction that is parallel to the local force of gravity. Unless specifically noted in this disclosure, the vertical direction is always perpendicular to horizontal.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A flagpole having decorative sporting equipment section comprising:

a decorative section, a pole, and a halyard;

wherein the decorative section substitutes for a length of the pole while simultaneously providing a novel appearance;

wherein the decorative section couples to the pole and serves as an extension of the pole;

wherein the decorative section resembles a sporting object;

wherein the pole is a hollow metal cylinder that serves to elevate a flag;

wherein the bottom of the pole is embedded into ground to hold the flagpole having decorative sporting equipment section upright;

wherein the bottom of the decorative section couples to the top of the pole;

wherein a truck assembly couples to the top of the decorative section;

wherein the truck assembly comprises a cap, an external pulley, a finial, and a threaded aperture for the finial;

wherein the truck assembly further comprises a halyard redirector;

wherein the halyard redirector is an internal pulley or a round, horizontal bar;

wherein the halyard redirector is located directly under the cap and inside of a top section of the flagpole;

wherein the halyard redirector redirects the movement of the halyard by 90 degrees so that vertical movement of the second run of rope up or down through the top section of the flagpole is translated into horizontal movement of the second run of rope between the halyard redirector and the external pulley.

2. The flagpole having decorative sporting equipment section according to claim 1 wherein the decorative section divides the pole into an upper pole and a lower pole;

wherein the bottom of the upper pole couples to the top of the decorative section;

wherein the bottom of the decorative section couples to the top of the lower pole;

wherein the truck assembly couples to the top of the upper pole.

3. The flagpole having decorative sporting equipment section according to claim 1 wherein the decorative section resembles a rifle.

4. The flagpole having decorative sporting equipment section according to claim 3 wherein the flagpole having decorative sporting equipment section comprises a cleat;

wherein the halyard is wrapped around the cleat to prevent the flag from moving up or down;

wherein the cleat is coupled to the pole or to the decorative section.

5. The flagpole having decorative sporting equipment section according to claim 4 wherein the halyard allows the flag to be raised and lowered from the ground;

wherein the halyard is a loop of rope having a first run of rope and a second run of rope;

wherein the flag is clipped onto the first run of rope;

wherein the flag is raised by pulling down on the second run of rope;

wherein the flag is lowered by pulling down on the first run of rope.

6. The flagpole having decorative sporting equipment section according to claim 5 further comprising a halyard aperture;

wherein the halyard aperture allows the second run of rope to pass through the center of the pole and through the decorative section to reach the truck assembly;

wherein the first run of rope runs from the truck assembly to the bottom of the flagpole having decorative sporting equipment section outside of the pole and outside of the decorative section;

wherein the halyard aperture is located on either the pole or the decorative section.

7. The flagpole having decorative sporting equipment section according to claim 6 wherein the pole is angled with respect to vertical.

8. The flagpole having decorative sporting equipment section according to claim 7 wherein a longitudinal axis of a barrel of the rifle and a longitudinal axis of a buttstock intersect at a first angle of intersection;

wherein the pole forms a second angle of intersection with respect to a vertical vector;

wherein the second angle of intersection is oriented to place its apex at the point where the bottom of the pole meets the ground;

wherein the second angle of intersection is the same angular measurement as the first angle of intersection.

9. The flagpole having decorative sporting equipment section according to claim 8 wherein a gun sight is a decorative part of the rifle and performs the function of providing an illumination for the flag at night;

wherein a light source is located at the top of the gun sight and point up towards the flag.

10. The flagpole having decorative sporting equipment section according to claim 9 wherein the light source is powered by an external power source, by batteries located within the decorative section.

11. The flagpole having decorative sporting equipment section according to claim 10 wherein the truck assembly is located at the top of the top section of the flagpole;

wherein the truck assembly reduces the friction of the halyard as it turns 180 degrees.

12. The flagpole having decorative sporting equipment section according to claim 11 wherein the cap forms a protective barrier at the top section of the flagpole;

wherein the cap provides a point of attachment for the finial in the form of the threaded aperture for the finial;

wherein the finial is a ornament for the top of the top section of the flagpole;

wherein the bottom of the finial provides a threaded interface that couples to the threaded aperture for the finial located on the cap.

13. The flagpole having decorative sporting equipment section according to claim 12 wherein the external pulley is coupled to an extension of the cap which places the center of the external pulley outside of the top section of the flagpole.

14. The flagpole having decorative sporting equipment section according to claim 13 wherein the external pulley is positioned entirely outside of the top section of the flagpole so that the second run of rope is directed down vertically from the external pulley and outside of the top section of the flagpole.

* * * * *